United States Patent [19]

Johnston

[11] 4,262,216

[45] Apr. 14, 1981

[54] FLOAT SWITCH

[75] Inventor: Stephen P. Johnston, Detroit Lakes, Minn.

[73] Assignee: S. J. Electro Systems, Inc., Detroit Lakes, Minn.

[21] Appl. No.: 35,221

[22] Filed: May 2, 1979

[51] Int. Cl.[3] ..... H01H 35/18

[52] U.S. Cl. ..... 307/118; 200/84 R; 340/625; 361/178

[58] Field of Search ..... 307/118, 142, 113, 116; 361/178, 192, 194, 189; 200/84 R, 84; 340/623, 624, 625, 508

[56] References Cited

U.S. PATENT DOCUMENTS

| | | | |
|---|---|---|---|
| 2,600,659 | 6/1952 | Koch | 340/623 X |
| 2,896,038 | 7/1959 | Gerber | 200/84 R X |
| 2,979,624 | 4/1961 | Askerneese | 307/114 X |
| 3,212,078 | 10/1965 | Shanahan | 340/506 |
| 3,291,934 | 12/1966 | Mealy | 73/308 X |
| 3,482,237 | 12/1972 | Hamburg et al. | 200/84 R X |
| 3,483,341 | 12/1969 | Reichensperger | 200/84 R |
| 3,832,702 | 8/1974 | Szeverenyi | 307/142 X |
| 3,866,470 | 2/1975 | Miller | 340/623 X |
| 4,086,457 | 4/1978 | Niedermeyer | 340/623 X |

*Primary Examiner*—L. T. Hix
*Assistant Examiner*—James L. Dwyer
*Attorney, Agent, or Firm*—Merchant, Gould, Smith, Edell, Welter & Schmidt

[57] ABSTRACT

A self-contained float switch for use in conjunction with water pumps and the like. The float switch operates to actuate and de-actuate such a pump at particular depths of water ($L_1$) and ($L_2$) which define an adjustable pumping range (R). In one embodiment the float switch consists of a cylindrical water-tight float (24) having an electrical cable (26) coming out of one end and terminating at a piggy-back plug (29) for insertion between a power output (20) and electric pump plug (18). The float contains six mercury switches (70–80) disposed obliquely to the axis of the float and equally spaced around the axis. Further circuitry including a relay (48) is provided to switch the heavier current load of the pump (12) in response to the electrical state of the mercury switches.

A further preferred embodiment of the float switch employs a double float system having an upper float (174) and lower float (176), each containing a single mercury switch (220 and 210 respectively) contained within the floats along the longitudinal central axis of the cylinder. The upper float (174) controls the maximum water level ($L_1$) and the lower float (176) controls the minimum water level ($L_2$).

11 Claims, 8 Drawing Figures

FIG. 1
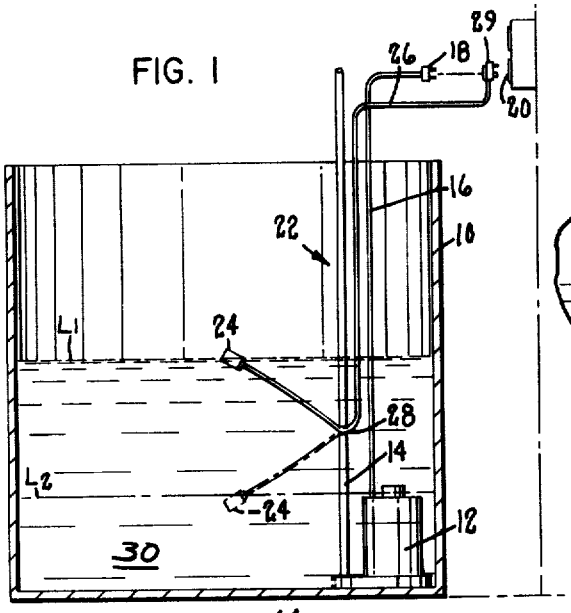
FIG. 2
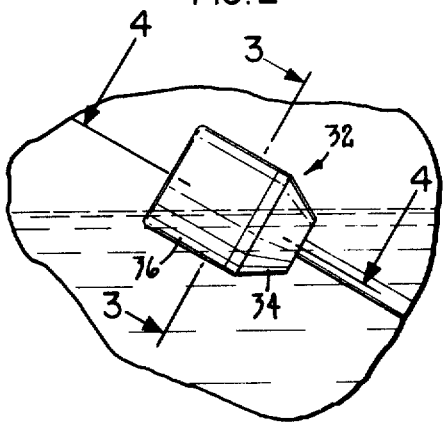
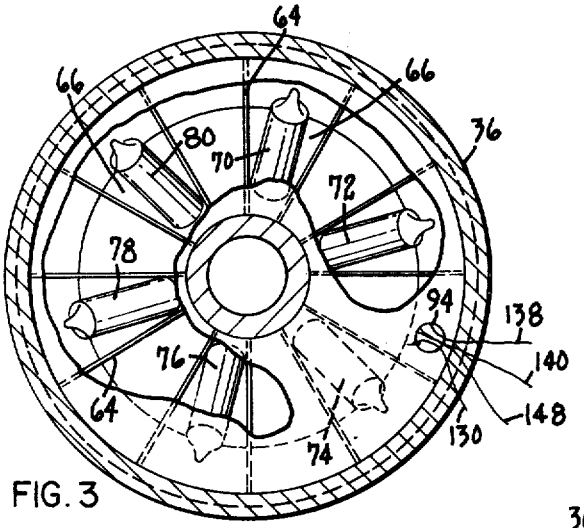
FIG. 3
FIG. 4
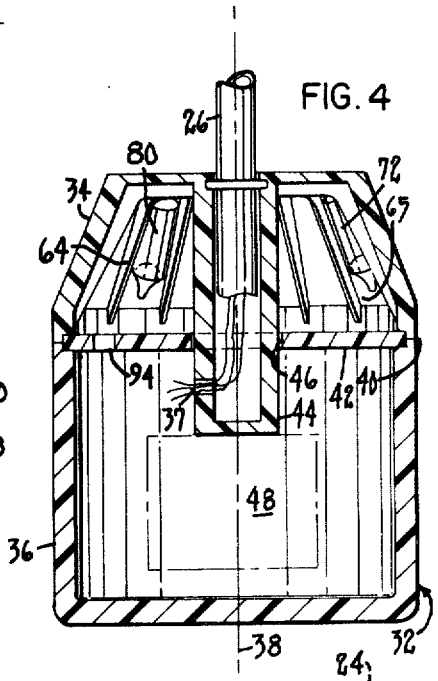
FIG. 5
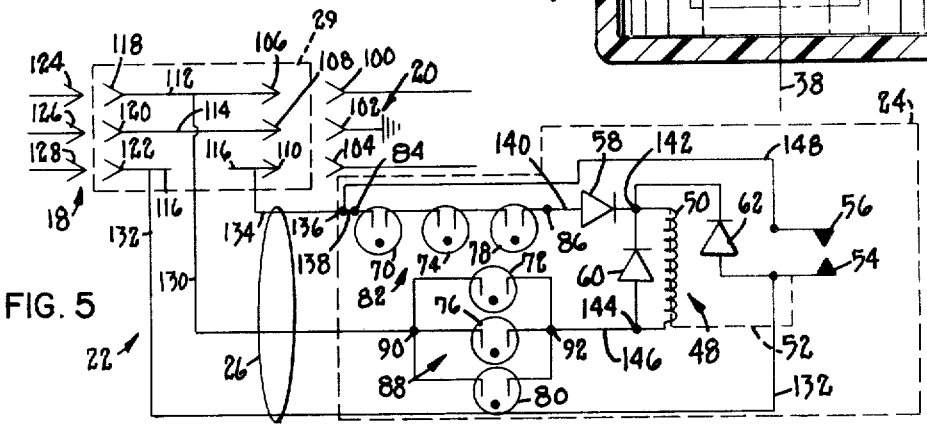

FIG. 6
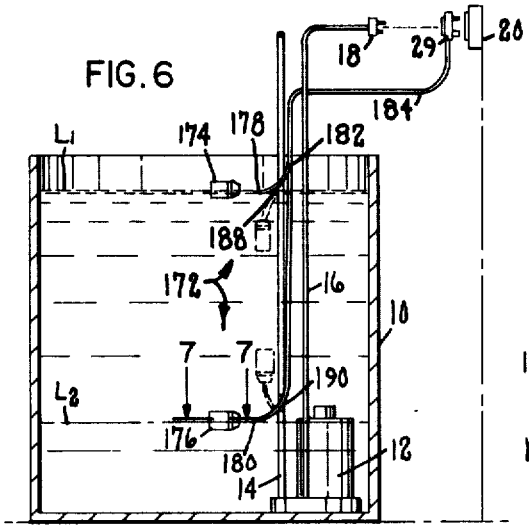
FIG. 7
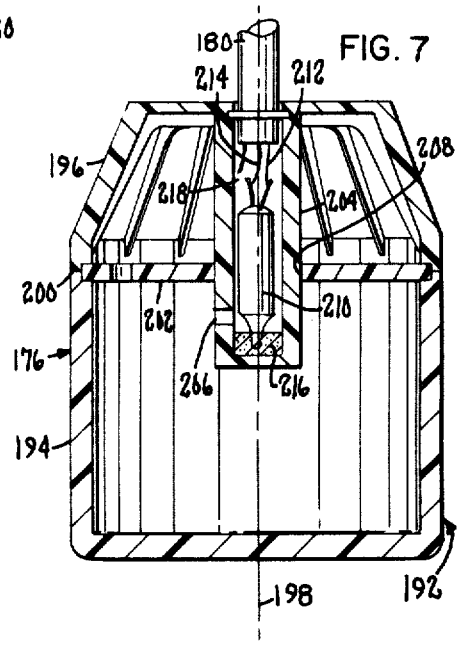
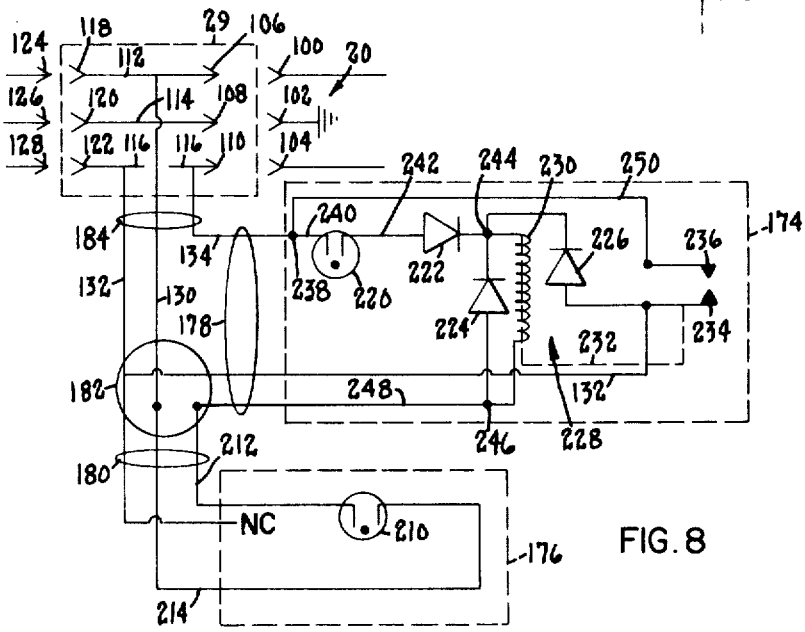
FIG. 8

FLOAT SWITCH

TECHNICAL FIELD

The present invention relates to switching means for responding to the level of a liquid, so as to energize or de-energize a pump motor, actuate an alarm or perform some similar electrical control function. Such devices are known as float switches.

BACKGROUND OF THE PRIOR ART

Numerous types of float switches are known. They may be physically integrated with the devices they control, or physically independent and connected to those devices only electrically. Again, the float may be mechanically connected to the electrical contacting elements, for switching at a site more or less remote from the actual float, or the contacting elements may be made a part of a float from which electrical rather than physical connections are extended.

Previous float switches have been characterized by rather limited range of operation, relatively complicated physical or electrical installation details, and difficulty of access for repair or maintenance, particularly when the unit to be controlled is in a submerged location.

BRIEF SUMMARY OF THE INVENTION

The present invention is a float switch designed for easy plug-in connection to an electrical device whose operation it controls, such as a pump for a water supply or drainage system designed to maintain the level of a liquid within a desired range. The float switch is typically includes a waterproof plastic float sealed at both ends and having a waterproof power cord or cable coming out of one end, for mechanical attachment to some fixed object by means such as an adjustable plastic strap arrangement, and for electrical interconnection with a power source and a device to be controlled.

Inside the plastic float are contained gravity responsive switch means and other electric circuitry for performing the desired function. The connection to the controlled device is made through a modified "piggy-back" plug which permits the float switch to be plugged in between the plug for the motor and a standard power outlet.

The density of the float is somewhat less than water, so that it will float at the surface of a body of water and support the weight of at least a short length of cable. The cable is secured, at a site therealong spaced from the float, to a fixed support, so that the float is free to move up and down in accordance with changes in the level of the liquid. The pumping range is determined by the length of cable between its point of securement and the float.

Several preferred embodiments of the float are shown, differing in the circuitry contained within the floats, and systems are shown using one or two floats, in water supply and drainage applications.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWINGS

In the drawings,

FIG. 1 is a view of a first preferred embodiment of the invention as used with a sump pump in a drainage system;

FIG. 2 is a side elevation, to a larger scale, of a portion of FIG. 1;

FIGS. 3 and 4 are sectional views taken along the lines 3—3 and 4—4 of FIG. 2, to a larger scale, parts being broken away;

FIG. 5 is a circuit diagram of the float switch and system of FIG. 1;

FIG. 6 is a view like FIG. 1 but showing a further preferred embodiment of the invention;

FIG. 7 is a sectional view along the line 7—7 of FIG. 6 to a larger scale; and

FIG. 8 is a diagram like FIG. 5 showing a circuit for the embodiment of the invention shown in FIGS. 6 and 7.

DETAILED DESCRIPTION OF THE INVENTION

Referring to the drawings in detail, there is shown in FIG. 1 a first preferred embodiment of the invention as arranged in a typical operating environment. A sump 10 has a submerged electric sump pump 12 with a discharge pipe 14 extending upward therefrom. Electric power is supplied to the motor of pump 12 through the conductors of a waterproof electric cable 16 terminating in a standard plug 18 for connection to a standard power outlet 20. The float switch 22 of the invention comprises float means 24, an electric cord or cable 26, means 28 for attaching cord 26 to pipe 14, and a modified "piggy-back" plug 29 to be interposed between pump plug 18 and outlet 20 as will presently be described.

Float 24 is shown in solid lines in FIG. 1 in the position it assumes when the water 30 in the sump is at a predetermined level $L_1$ at which pump operation is intended to be started: in broken lines float 24 is shown in the position it assumes when the water is at a level $L_2$ at which pump operation is to be interrupted. The distance $L_1$-$L_2$ is the "pumping range," R, of the system, and can be preselected as will be explained below.

As shown in FIGS. 2-4, float means 24 comprises a hollow watertight housing 32 conventionally having a closed conical end 34 and a closed cylindrical end 36, which are coaxial about an axis 38 and have their rims sealed together at 40: they are separated by a partition 42. The apex angle of the cone is preferably about 60 degrees. End 34 is provided with a closed reentrant tubular portion 44 which passes through an aperture 46 in partition 42 into end 36, to sealingly receive one end of cable 26, the conductors of which may pass laterally through an aperture 37 into housing end 36. Member 44 also serves inwardly as a mount for a conventional DC relay 48 having a winding 50 (see FIG. 5) which actuates an armature 52 to displace a movable contact 54 with respect to a fixed contact 56: the figure shows contacts 54 and 56 as of the normally-open type. Also mounted in end 36 are a rectifying diode 58, a free-wheeling diode 60, and a holding diode 62.

The inner conical surface of end 34 is divided by radial partitions 64 into a plurality of chambers 66 in which gravity responsive single-pole switches 70, 72, 74, 76, 78 and 80 are secured as by cementing. These switches are symmetrical about axis 38, and all are "normally-open" or "normally-closed" depending on details of the application of the float switch. In the arrangement shown in FIGS. 1–5 the switches are all "normally-open," that is, they all open their circuits when the housing is oriented as shown in FIG. 4 with end 36 downward. Switches 70–80 are arranged in two symmetrical sets of three about axis 38, the first set 70, 74, 78 being interconnected in a series circuit 82 having terminals 84 and 86, and the second set 72, 76, 80 being interconnected in a parallel circuit 88 having terminals 90 and 92. As shown, the switches of the two sets alternate: to avoid complicating the drawings the interconnecting wires are not shown further than to indicate that conductors as will be identified below pass through partition 42 at an aperture 94 for connection to cable 26 or elements within cylindrical end 36.

In FIG. 5, outlet 20 is of the conventional type having female connectors 100 and 104 between which an alternating voltage, of say 120 volts, may exist, and a further female connector 102 to provide a continuous ground. Piggy-back plug 29 has male connectors 106, 108 and 110 for engaging connectors 100–104 and continuing their circuits, by means of internal conductors 112, 114 and 116, to female connectors 118, 120, 122, which receive the male connectors 124, 126, and 128, all respectively, of plug 18. Conductor 114 is unmodified. Conductor 112 is tapped by a further conductor 130, and conductor 116 is broken, further independent conductors 132 and 134 being connected to connectors 122 and 110 respectively: conductors 130, 132 and 134 comprise cable or cord 26 of FIGS. 1 and 4.

In FIG. 5 a pilot circuit may be traced from connector 110 through conductor 134, junction point 136, conductor 138, terminal 84, series circuit 82, terminal 86, conductor 140, diode 58, junction point 142, relay winding 50, junction point 144, conductor 146, terminal 92, parallel circuit 88, terminal 90, and conductor 130 to conductor 112. Diode 60 is connected, in reverse polarity with respect to diode 58, between junction points 142 and 144. A power circuit may also be traced from connector 110 through conductor 134, junction point 136, conductor 148, relay contacts 56 and 54 when closed, and conductor 132 to connector 122, thus completing the circuit from connector 110 to connector 122. Diode 62 is connected between relay contact 54 and junction point 142.

Turning now to FIG. 6, a drainage system is there shown which uses another float switch according to the invention. Here a sump 10 has a submerged electric sump pump 12 with a discharge pipe 14 extending upward therefrom. Electric power is supplied to the motor of pump 12 through the conductors of a waterproof electric cord or cable 16 terminating in a standard plug 18 for connection to a standard power outlet 20.

The float switch 172 of this embodiment comprises upper and lower floats 174 and 176 having cables 178 and 180 spliced at 182 and continued as a cable 184 to modified piggy-back plug 29. Cables 178 and 180 are secured to discharge pipe 14 at 188 and 190 in such fashion that float 174 determines the upper level $L_1$ of liquid and float 176 determines the lower level $L_2$ of the liquid. It will be apparent that the pumping range $L_1$–$L_2$ is much greater in this arrangement than could be accomplished in the arrangement of FIG. 1 unless the unsupported length of cable between the float and the point of cable securement were made very long, which would be impossible in sumps of small diameter.

Referring now to FIG. 7, float 176 is shown to comprise a hollow watertight housing 192 conveniently having a closed cylindrical end 194 and a closed conical end 196 which are coaxial about a common axis 198 and have their rims sealed together at 200 and separated by a partition 202. End 196 is provided with a closed reentrant tubular portion 204 having a lateral aperture 206, which passes through a further aperture 208 in partition 202. One end of cable 180 is sealingly received in tubular portion 204.

A gravity responsive device 210 is contained in tubular portion 202, being supported at one end by conductors 212 and 214 of cable 180, to which it is connected, and at the other end by a resilient pad 216, the whole being preferably potted in a suitable epoxy or other compound 218. Device 210 may conveniently comprise a mercury switch so constructed that when housing 192 is positioned with its axis 198 vertical, as shown in FIG. 7, the switch is open.

Float 174 comprises a housing as shown in FIG. 7, except that it sealingly receives one end of cable 178 rather than of cable 180, and that aperture 206 enables the passage of the cable conductors, and of conductors connected to a gravity responsive device 220, into the cylindrical end of the housing, the latter containing three diodes 222, 224 and 226 (See FIG. 8) and a relay 228 having a winding 230 which actuates an armature 232 to displace a movable contact 234 with respect to a fixed contact 236, as described in connection with FIG. 4.

Turning again to FIG. 8, plug 18, modified piggy-back plug 29, and outlet 20 are exactly as in FIG. 3, and have been given the same reference numerals.

A pilot circuit may be traced from connector 110 through conductor 134 of cables 184 and 178, junction point 238, conductor 240, gravity responsive device 220, conductor 242, rectifier diode 222, junction point 244, relay winding 230, junction point 246, and conductor 248 of cable 178, which is spliced at 182 to conductor 212 of cable 180, the circuit being completed through float 176 by device 210 and conductor 214 of cable 180, which is spliced at 182 to conductor 130 of cable 184 and which completes the circuit to conductor 112 and connector 106. Diode 224 is connected, in reverse polarity with respect to diode 222, between junction points 244 and 246.

A power circuit may be traced from connection 110 through conductor 134 of cables 184 and 178, junction point 238, conductor 250, relay contacts 236 and 234 when closed, and conductor 132 of cables 178 and 184 to conductor 116 and connector 122. Diode 226 is connected between relay contact 234 and junction point 244.

OPERATION

The operation of the embodiment of the invention shown in FIGS. 1–5 will first be explained. At a time when sump 10 is substantially empty of water the cable 26 of a float switch 22 is secured by strapped clamps or other suitable means to discharge pipe 14 or some other fixed point. The point at which the cable is secured on pipe 14 is substantially the middle of the pumping range desired, and the levels $L_1$ and $L_2$ are equally above and below the level of that securing point. The range R is determined by the distance D along cable 26 from float 24 at which the cable is secured. In one embodiment of the invention the distances given in Table 1 were found to prevail.

TABLE 1

| R | D |
|---|---|
| 7-10" | 3.5" |
| 9-12" | 5" |
| 10-14" | 7" |
| 12-16" | 9" |
| 16-20" | 11" |
| 17-23" | 13" |
| 20-26" | 15" |
| 24-32" | 17" |

In the circuit of FIG. 5 the purpose of the switches in circuit 82 is to turn on the pump motor, and the purpose of the switches in circuit 88 is to shut off the pump motor. Two separate switch sets are provided to prevent surges and other transient and essentially insignificant changes in liquid levels, which might otherwise exceed the differential of a single switch, from continuously switching the pump on and off. The reason for having a plurality of switches in these two circuits is to ensure that system operation will take place reliably regardless of any rocking of float 24 about its axis 38.

In installing the system the float 24 is preferably positioned so that a switch of parallel circuits 88 is lowermost and a switch of series circuit 82 is uppermost, to give maximum pumping range. Housing 32 may be externally marked to facilitate this operation.

Consider the system just after pump operation has ceased and the liquid is at at $L_2$. Float 24 is in its broken line position. All of switches 70-80 are open, relay contacts 56 and 54 are disengaged, line voltage exists between conducts 130 and 134, and no current flows in any diode. As liquid enters sump 10 the level gradually rises above $L_2$, and float 24 rises with it. By reason of the constraint supplied by cable 26 connected to the float, the rise of the float is accompanied by tilting of axis 38. Presently, the lowermost of switches 70-80 closes its contacts. If it is one of switches 70, 74 and 78, the series circuit remains incomplete at the remainder of those switches: if it is one of switches 72, 76 and 80, a circuit from junction point 144 to connection 100 is completed, but the pilot circuit remains broken at series circuit 82. As liquid continues to enter the sump the float continues to rise and tilt, closing first one and then another of switches 70, 74 and 78.

By reason of the symmetry of mounting of the switches, at least two of switches 72, 76 and 80 must be closed before all of switches 70, 74 and 78 are closed, but this point is eventually reached at level $L_1$. It completes the pilot circuit explained above: relay winding 50 is energized through series circuit 82 and parallel circuit 88, and the relay operates to close contacts 54 and 56. This in turn completes the power circuit from connection 104 to connection 128 and energizes the pump motor: it also completes a holding circuit around switches 70, 74 and 78 and diode 58, which may be traced from junction point 136 through conductor 148, relay contacts 56 and 54, and diode 62 to junction point 142. Now transient variations in the liquid surface to momentarily open the last-closed series switch cannot de-energize the pump motor. Liquid is pumped from the sump and the level falls, opening the switches of the series and parallel circuits in an order generally the reverse of that in which they were closed, until finally the last switch of the parallel circuit opens. This interrupts the holding circuit: series circuit 82 in the pilot circuit has previously been opened because of switch symmetry. Relay 48 is de-energized, opening the power circuit, and operation of the pump motor ceases, any transient involved in the switching being suppressed in diode 60.

Recapitulating, pump operation cannot begin until all of switches 70, 74, and 78 are closed, and cannot terminate until all of switches 72, 76 and 80 are open. This arrangement makes available a pumping range far greater than the differential of any available gravity responsive device.

The invention is not limited to "pumping down" applications. To adapt it for "pumping up" operations, such as maintaining a supply of liquid in a cistern, switches 70-80 are cemented into float 24 in inverted sense, that is, so that when the float is in the position shown in FIG. 4 all the switches are closed.

While a plurality of switches are shown in circuits 82 and 88, this may not be necessary, particularly when the length of cable between float 24 and pipe 14, and the torsibility of the cable, are small so that little movement of the float about axis 38 takes place. In such a case a single "series" switch and a single "parallel" switch are provided in chambers 66 which are diammetrically opposed across axis 38. By way of definition, a "series" switch is one connected between conductor 134 and diode 58 in FIG. 3, and a "parallel" switch is one connected between conductors 146 and 130. The outside of cylinder 36 for a float switch so simplified is marked to identify the diameter across which the switches are located, and also to identify which end of the diameter receives the "series" switch. Then in installing the float switch the cable 26 should be so rotated before clamping to pipe 14 that the identified diameter extends vertically. If the system is to be for pumping down, the "series" switch should be uppermost, while if the system is for pumping up, the "parallel" switch should be uppermost.

The operation of the embodiment of the invention shown in FIGS. 6-8 will now be explained. In this system two floats are used which externally appear identical. To facilitate installation float 174, which contains relay 228, the three diodes, and switch 220, and which by an analogy be called the "series" float, is molded of grey plastic, while float 176, which contains the switch 210 only, and may be called the "parallel" switch, is molded of black plastic. Since switches 210 and 220 are both mounted with their working axes parallel to the axes of the floats, the latter assume somewhat different positions from float 24, as is shown in FIG. 6. When the liquid level is at $L_2$ the axis of float 176 is horizontal and that of float 174 is vertical, with the conical end uppermost. When the liquid level is at $L_1$ the axis of float 174 is horizontal, and that of float 176 is vertical, with the conical end lowermost.

This embodiment operates in the pumping down mode, that is, with grey float 174 uppermost and black float 176 lowermost, as follows. Consider the system just after pump operation has ceased when the liquid level is at $L_2$. Float 176 is in its solid line position, and float 174 is in its broken line position. Switches 210 and 220 are both open, relay contacts 234 and 256 are de-energized, line voltage exists between conductors 130 and 134, and no current flows in any diode. As water enters sump 10 the liquid gradually rises above $L_2$: float 176 tilts and switch 210 closes, and a circuit from junction point 246 to connection 106 is completed, but the pilot circuit remains broken at switch 220. As liquid continues to enter the sump, float 176 tilts to its broken line position, and then float 174 begins to tilt from its broken line position: when the liquid reaches level $L_1$ float 174 has reached its solid line position and switch 220 closes. The pilot circuit is now complete: relay winding 230 is energized through switches 210 and 220 and the relay operates to close contacts 234 and 236. This in turn completes the power circuit from connector 104 to connector 128 and energizes the pump motor: it also completes a holding circuit around switch 220 and rectifier 220 and 222 which may be traced from junction point 238 through conductor 250, relay contacts 236 and 234, and diode 226 to junction point 244. Now transient variations in the liquid surface cannot de-energize the relay. The liquid is pumped from the sump, and as the level falls, float 178 returns to its broken line position and opens switch 220, but pumping operation is maintained by the holding circuit. Pumping operation continues until float 176 moves from its broken line position to its solid line position, when switch 210 opens, interrupting the holding circuit and the pilot circuit, and relay 228 is de-energized to de-energize the pump.

As before, the float switch of this embodiment can be adapted for pumping up use. This is accomplished by reversing the mounting of switches 210 and 220 in their floats, so that in the float attitude of FIG. 7 for example, the switches are "on" rather "off," and by mounting the grey float 174 in the lower position and the black float 176 in the upper position.

From the foregoing it will be evident that I have invented a float switch which is self-contained, which is simple to install mechanically and electrically, and which is capable of giving any desired pumping range while being insensitive to surge and other transients in liquid level.

While the invention has been described specifically as used in systems for the control of the level of water, it will also be useful in management of other liquids to which the floats and cables are resistant.

Numerous characteristics and advantages of my invention have been set forth in the foregoing description, together with details of the structure and function of the invention, and the novel features thereof, are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A float switch comprising, in combination:

a hollow liquidtight housing having an axis, and arranged to float in a liquid;

electrical conducting means extending axially from said housing in a flexible liquidtight cable; and electrical switching means mounted within said housing and including a relay, having a pair of contacts connected to said conducting means, for opening and closing the circuit therebetween in accordance with changes in the orientation of said housing, and sets of gravity responsive switching means having working axes extending obliquely with respect to said axis in at least three planes containing said axis for controlling said relay, the switching means of one of said sets being connected in series and the switching means of another of said sets being connected in parallel.

2. A float switch according to claim 1 in which the switches of said sets are arranged symmetrically and alternately about said axis on a conical surface.

3. A float switch according to claim 1 in which said relay includes a winding, connected in a first series circuit with said sets of gravity responsive switching means, said first series circuit being connected to two of said conducting means.

4. A float switch according to claim 3 in which a first of said contacts is connected to one of said two conducting means and a second of said contacts is connected to a third of said conducting means, and unidirectional conductive means connected from said second contact to said first series circuit at a point between said first switching means and said winding but not between said second switching means and said winding.

5. In a control system, in combination:

(a) a source of electrical energy;

(b) first and second circuits energized from said source, said first circuit including the winding of a DC relay, a first unidirectional conductor, and first and second switching means having states of open circuit and closed circuit and interconnected in a series circuit so that unidirectional current flows through said winding and said first unidirectional conductor when said switching means are in said closed circuit state, and said second circuit including a utilization device and a pair of contacts actuated by said relay between open and closed circuit states;

(c) and a second unidirectional conductor connected from one of said contacts to a point in said first circuit to provide a holding circuit for said relay regardless of the state of one of said switching means and mutually isolate said circuit.

6. A control system according to claim 5 in which said first switching means includes a plurality of switches connected in series.

7. A control system according to claim 5 in which said second switching means includes a plurality of switches connected in parallel.

8. A control system according to claim 5 in which said first switching means includes a plurality of switches connected in series, and second switching means includes a plurality of switches connected in parallel.

9. A control system according to claim 5 in which said point in said first circuit means is between said relay winding and said first switching means, but not between said relay winding and said second switching means.

10. A self-contained float switch for controlling the electrical energization of a device having a connection plug adapted for insertion into a power outlet, comprising, in combination:

a hollow, liquidtight housing having an axis and arranged to float in liquid;

electrical conductors extending axially from said housing in a flexible liquidtight table;

connector means insertable between said connection plug and said power outlet, for continuing a first conduction path directly therebetween and making a connection thereto along one of said electrical conductors, and for interrupting a second conducting path directly therebetween and continuing it along a pair of said electrical conductors; and electrical switching means mounted within said housing and energizable through said one of said conductors for opening and closing a circuit, including said pair of conductors, in accordance with changes in the orientation of said housing, said switching means comprising a relay and a pair of gravity responsive switch means extending obliquely with respect to said axis in a common plane, and in which said housing is externally configured to indicate the location of said plane.

11. A system for controlling the level of a body of liquid comprising, in combination:

electrically energizable pump means for changing the level of said liquid;

a source of electrical energy;

and self-contained switch means connected for energizing said pump means from said source when said liquid reaches a first level and for deenergizing said pump means when said liquid reaches a second level, said switch means comprising float means and electrically conducting means extending from said float means for mechanically mounting said float means in said liquid, said float means comprising floats mounted at said first and second levels and containing gravity responsive switch members, one of said floats containing a relay actuable to energize said pump means from said source.

* * * * *